US010881139B2

(12) United States Patent
Li et al.

(10) Patent No.: US 10,881,139 B2
(45) Date of Patent: Jan. 5, 2021

(54) NON-COMBUSTIBLE VAPING ELEMENT WITH TOBACCO INSERT

(71) Applicant: Altria Client Services LLC, Richmond, VA (US)

(72) Inventors: San Li, Richmond, VA (US); Ben Ragland, Providence Force, VA (US); Diane Gee, Richmond, VA (US); Raquel Olegario, Richmond, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 521 days.

(21) Appl. No.: 15/204,272

(22) Filed: Jul. 7, 2016

(65) Prior Publication Data

US 2018/0007966 A1 Jan. 11, 2018

(51) Int. Cl.

| | |
|---|---|
| ***A24F 47/00*** | (2020.01) |
| ***A24B 15/16*** | (2020.01) |
| ***A61M 15/06*** | (2006.01) |

(52) U.S. Cl.

CPC ..... *A24F 47/008* (2013.01); *A24B 15/16* (2013.01)

(58) Field of Classification Search

None

See application file for complete search history.

(56) References Cited

U.S. PATENT DOCUMENTS

| | | | | |
|---|---|---|---|---|
| 4,922,901 A * | 5/1990 | Brooks | ..... | A24F 47/006 128/202.27 |
| 4,947,874 A * | 8/1990 | Brooks | ..... | A24F 47/008 128/202.21 |
| 5,249,586 A | 10/1993 | Morgan et al. | | |
| 5,261,424 A * | 11/1993 | Sprinkel, Jr. | ..... | A24F 47/008 128/202.21 |

(Continued)

FOREIGN PATENT DOCUMENTS

| | | |
|---|---|---|
| CN | 203952436 U | 11/2014 |
| EA | 013046 | 2/2010 |

(Continued)

OTHER PUBLICATIONS

International Search Report and Written Opinion for Application No. PCT/EP2017/067170 dated Nov. 2, 2017.

(Continued)

*Primary Examiner* — Thor S Campbell

(74) *Attorney, Agent, or Firm* — Harness, Dickey & Pierce, P.L.C.

(57) ABSTRACT

An e-vaping device may include a pre-vapor formulation tank configured to hold a pre-vapor formulation, an adaptor that includes a vaporizer assembly configured to vaporize the pre-vapor formulation, and a flavor insert positioned to receive vapors formed by the vaporizer assembly. The flavor insert may hold at least one flavorant. The tank, adaptor, and flavor insert may be a non-combustible vaping element that includes a channel into which the flavor insert may be inserted to be positioned to receive the vapors. The flavor (Continued)

insert and the vaporizer assembly may be at opposing ends of the channel. The flavor insert may be a detachable insert configured to be inserted into the tank element. The flavor element may be a tobacco element. The tobacco element may be at least a portion of a cigarette.

24 Claims, 5 Drawing Sheets

(56) References Cited

U.S. PATENT DOCUMENTS 5,479,948 A * 1/1996 Counts ..... A24F 47/008 131/194
5,730,158 A * 3/1998 Collins ..... A24F 47/008 131/194
8,156,944 B2 * 4/2012 Han ..... A24F 47/008 131/273
8,387,612 B2 * 3/2013 Damani ..... A61M 11/041 126/263.01
8,733,346 B2 5/2014 Rinker
8,997,754 B2 * 4/2015 Tucker ..... H01C 17/00 131/273
9,220,298 B1 * 12/2015 En'Wezoh ..... A24D 1/18
9,750,282 B2 * 9/2017 Liu ..... G01F 1/661
2012/0285475 A1 * 11/2012 Liu ..... A24F 47/008 131/329
2013/0213419 A1 * 8/2013 Tucker ..... A24F 47/008 131/328
2013/0228191 A1 * 9/2013 Newton ..... A24F 47/008 131/329
2014/0166029 A1 6/2014 Weigensberg et al.
2014/0261492 A1 * 9/2014 Kane ..... A24F 47/008 131/328
2016/0120224 A1 * 5/2016 Mishra ..... A24F 47/008 392/390
2016/0120225 A1 * 5/2016 Mishra ..... A24F 47/008 392/386
2016/0120228 A1 * 5/2016 Rostami ..... A24F 47/008 131/329
2016/0143361 A1 * 5/2016 Juster ..... A24F 47/008 392/404
2016/0174610 A1 * 6/2016 Kuczaj ..... A24F 47/008 131/328
2016/0374398 A1 * 12/2016 Amir ..... A24F 47/008 392/386

FOREIGN PATENT DOCUMENTS

KR 101552254 B1 9/2015
RU 2014138085 A 4/2016
WO WO-2014/132045 A2 9/2014
WO WO-2016062777 A1 4/2016
WO WO-2016179376 A1 11/2016

OTHER PUBLICATIONS

Russian Search Report and English translation thereof dated Oct. 26, 2020.
Russian Decision to Grant and English translation thereof dated Oct. 26, 2020.

* cited by examiner

NON-COMBUSTIBLE VAPING ELEMENT WITH TOBACCO INSERT

BACKGROUND

Field

Example embodiments relate to electronic vaping devices, e-vaping devices, and/or non-combustible vaping devices.

Description of Related Art

E-vaping devices, also referred to herein as electronic vaping devices (EVDs) may be used by adult vapers for portable vaping. Flavored vapors within an e-vaping device may be used to deliver a flavor along with the vapor that may be produced by the e-vaping device. The flavored vapors may be delivered via a flavor system.

E-vaping devices include a heater which vaporizes pre-vapor formulation to produce a vapor. An e-vaping device may include several e-vaping elements including a power source, a cartridge or e-vaping tank including the heater and along with a reservoir capable of holding the pre-vapor formulation.

SUMMARY

According to some example embodiments, a non-combustible vaping element may include a pre-vapor formulation tank, a heating element coupled to the pre-vapor formulation tank, and a tobacco element. The pre-vapor formulation tank may be configured to contain a pre-vapor formulation. The pre-vapor formulation tank may define a chancel there through. The heating element may be coupled to the pre-vapor formulation tank and may be configured to heat at least a portion of the pre-vapor formulation into a vapor and provide the vapor to a first portion of the channel. The tobacco element may be at a second portion of the channel and positioned to receive the vapor.

The tobacco element and the heating element may be at opposing ends of the channel.

The tobacco element may be a detachable insert configured to be inserted into the channel, the detachable insert including a tobacco flavor material.

The detachable insert may include a filter at an end of the tobacco flavor material.

The detachable insert may include tipping paper overlapping the filter and the tobacco flavor material.

The tipping paper may cover outer surface areas of the filter and the tobacco flavor material.

The tipping paper may cover an entire outer surface area of the tobacco flavor material.

The detachable insert may include a flavor material. The flavor material may hold at least one flavorant.

The pre-vapor formulation may include nicotine.

According to some embodiments, a non-combustible vaping device may include a power supply section configured to supply power; and a non-combustible vaping element configured to receive the supplied power. The non-combustible vaping element may include a pre-vapor formulation tank configured to contain a pre-vapor formulation, a heating element coupled to the pre-vapor formulation tank, and a tobacco element. The pre-vapor formulation tank may define a channel there through. The heating element may be configured to heat at least a portion of the pre-vapor formulation into a vapor using the supplied power. The heating element may be configured to provide the vapor to a first portion of the channel. The tobacco element may be at a second portion of the channel and may be positioned to receive the vapor.

The tobacco element and the heating element may be at opposing ends of the channel.

The tobacco element may be a detachable insert configured to be inserted into the channel. The detachable insert may include a tobacco flavor material.

The detachable insert may include a filter at an end of the tobacco flavor material.

The detachable insert may include tipping paper overlapping the filter and the tobacco flavor material.

The tipping paper may cover outer surface areas of the filter and the tobacco flavor material.

The tipping paper may cover an entire outer surface area of the tobacco flavor material.

The detachable insert may include a flavor material. The flavor material may hold at least one flavorant.

The pre-vapor formulation may include nicotine.

According to some example embodiments, an e-vaping element may include a pre-vapor formulation tank configured to contain a pre-vapor formulation, a heating element coupled to the pre-vapor formulation tank, and a detachable insert. The pre-vapor formulation tank may be configured to contain a pre-vapor formulation. The pre-vapor formulation tank may define a channel there through. The heating element may be configured to heat at least a portion of the pre-vapor formulation into a vapor and provide the vapor to a first portion of the channel. The detachable insert may be configured to be inserted into the channel at a second portion of the channel such that the detachable insert is positioned to receive the vapor. The detachable insert may include a flavor material holding at least one flavorant. The detachable insert may be configured to release the at least one flavorant into the received vapor.

The pre-vapor formulation may include nicotine.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1A:
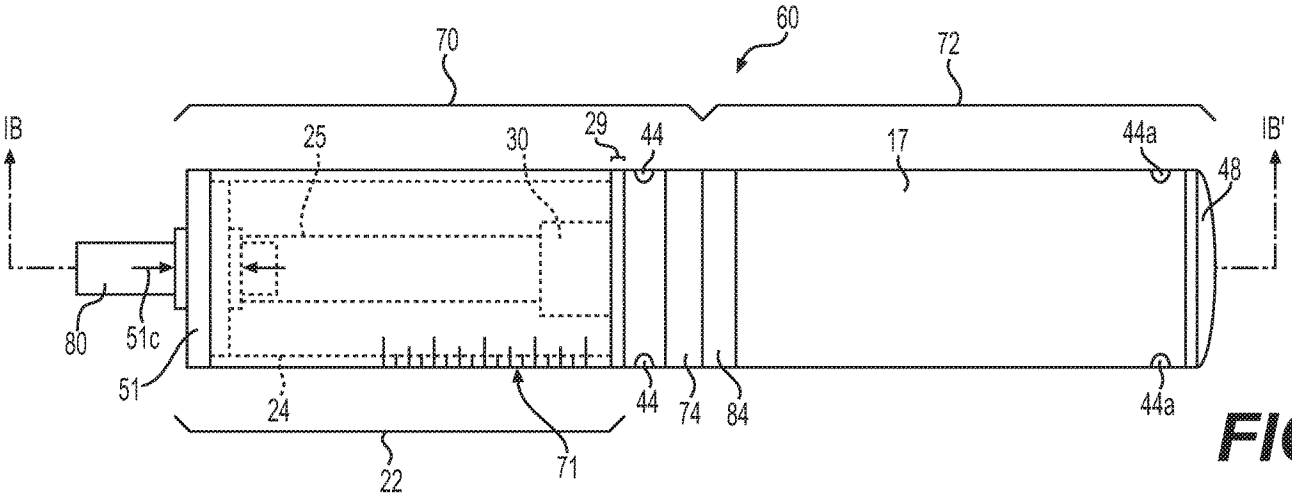
FIG. 1A is a side view of an e-vaping device according to some example embodiments.

Some detailed example embodiment are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, elements, regions, layers and sections, these elements, elements, regions, layers, and/or sections should not be limited by these terms. These terms are only used to distinguish one element, element, region, layer, or section from another region, layer, or section. Thus, a first element, element, region, layer, or section discussed below could be termed a second element, element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or elements, but do not preclude the presence or addition of one or more other features, integers, steps, operations, elements, elements, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 1B:
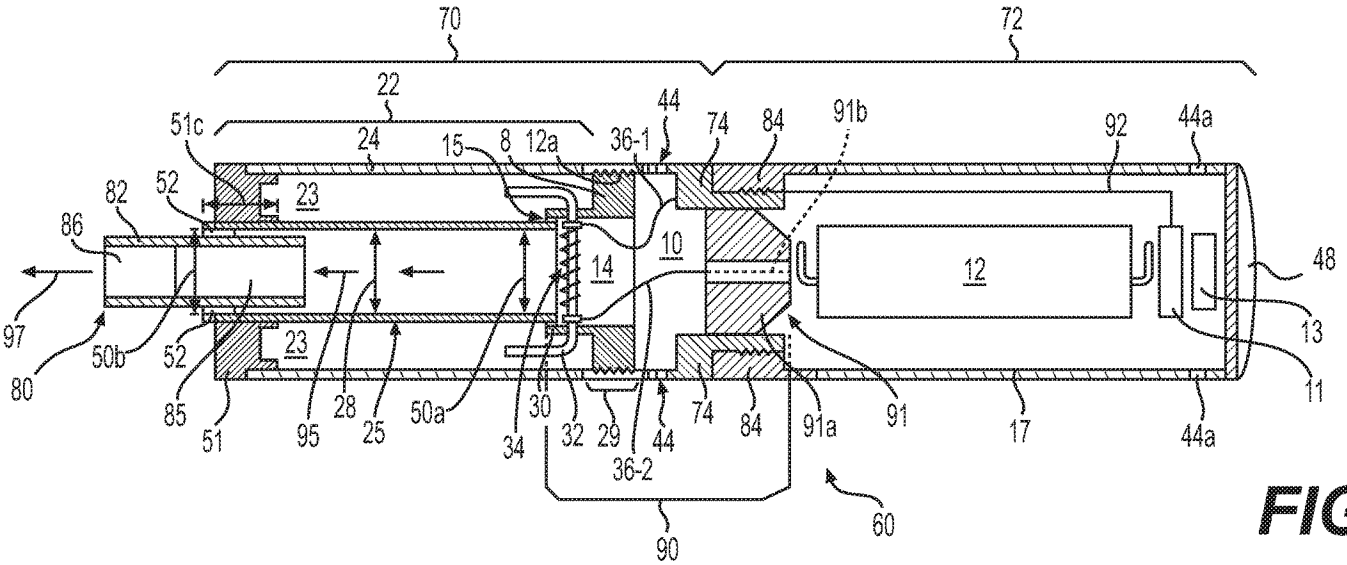
FIG. 1B is a cross-sectional view along line IB-IB' of the e-vaping device of FIG. 1A.
Figure 1C:
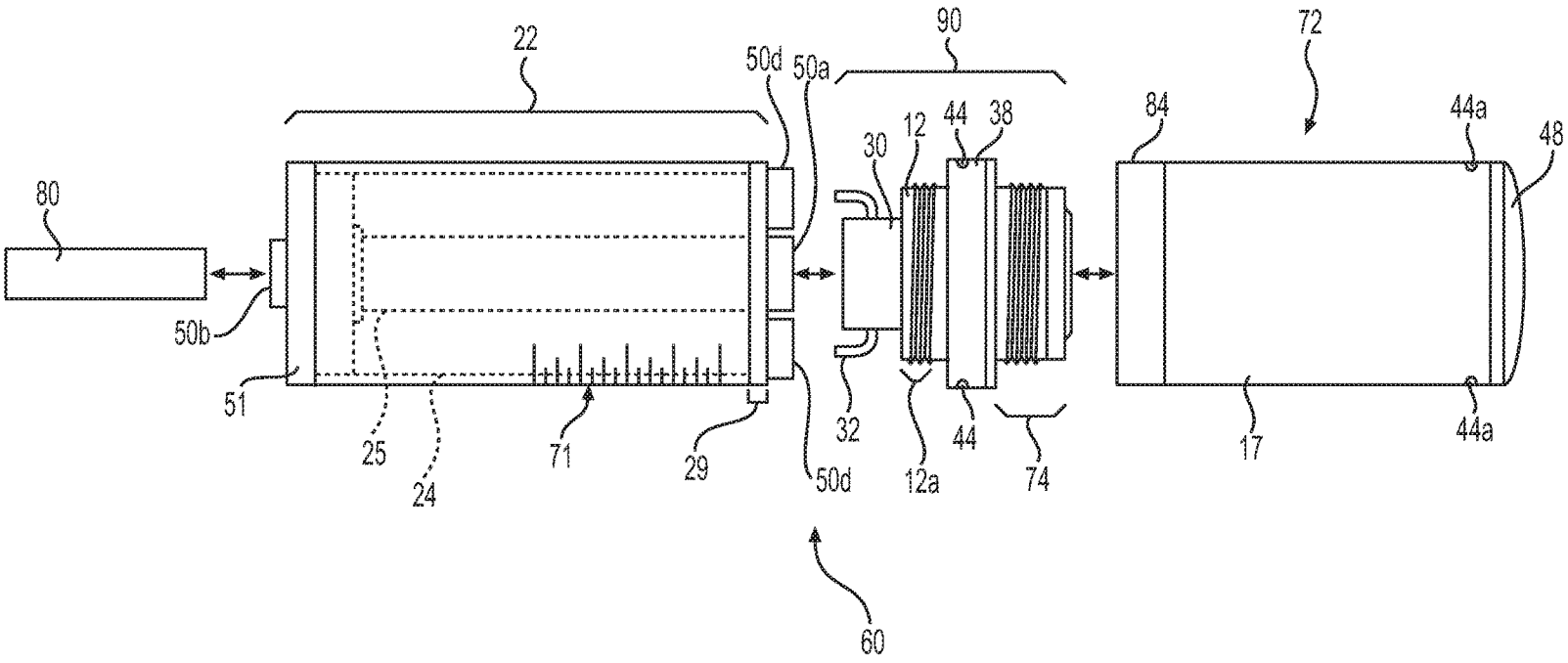
FIG. 1C is an exploded view of an e-vaping device according to some example embodiments.

FIG. 1A is a side view of an e-vaping device 60 according to some example embodiments. FIG. 1B is a cross-sectional view along line IB-IB' of the e-vaping device of FIG. 1A. FIG. 1C is an exploded view of an e-vaping device according to some example embodiments. The e-vaping device 60 may include one or more of the features set forth in U.S. Patent Application Publication No. 2013/0192623 to Tucker et al. filed Jan. 31, 2013 and U.S. Patent Application Publication No. 2013/0192619 to Tucker et al. filed Jan. 14, 2013, the entire contents of each of which are incorporated herein by reference thereto. As used herein, the term "e-vaping device" is inclusive of all types of electronic vaping devices, regardless of form, size or shape. In some example embodiments, the e-vaping device 60 is a non-combustible vaping device.

Referring to FIGS. 1A-C, the e-vaping device 60 includes a replaceable pre-vapor formulation tank section (or first section) 70, sometimes referred to herein as an "e-vaping tank," a reusable power supply section (or second section) 72, and a flavor insert 80. The sections 70, 72 may be coupled together at complimentary interfaces 74, 84 of the respective sections 70, 72. The flavor insert 80 may be coupled to the pre-vapor formulation tank section 70 via being inserted into an opening Sob of the channel 28 in the pre-vapor formulation tank section 70. The flavor insert 80 may be positioned at an outlet portion of the channel 28 based on being inserted into the opening 50*b*. The flavor insert 80 may be positioned to receive a vapor formed by the pre-vapor formulation tank section 70, based on being positioned at the outlet portion of channel 28.

In some example embodiments, the interfaces 74, 84 are threaded connectors. It should be appreciated that an interface 74, 84 may be any type of connector, including, without limitation, a snug-fit, detent, clamp, bayonet, and/or clasp.

Pre-vapor formulation tank section 70 may include a pre-vapor formulation tank 22 and an adaptor 90. The pre-vapor formulation tank 22 and adaptor 90 may be connected via connector elements 29, 12*a* (e.g., respective male and female threaded connections), respectively. Connector elements 29, 12*a* may be complimentary connectors. The adaptor 90 includes interface 74 and couples pre-vapor formulation tank 22 to the power supply section 72 through the coupling of interfaces 74, 84 and 29, 12*a*.

Still referring to FIGS. 1A-C, pre-vapor formulation tank 22 includes an outer tube 24 (or housing) extending in a longitudinal direction, an inner tube 25 extending in the longitudinal direction, and a gasket assembly 51 defining an outlet end of the pre-vapor formulation tank 22. An opposite end (tip end) of the pre-vapor formulation tank 22 includes tip ends of the outer housing 24 and inner tube 25, respectively.

In some example embodiments, the outer housing 24 may be a single tube housing both the pre-vapor formulation tank section 70 and the power supply section 72 and the entire e-vaping device 60 may be disposable. As shown in the example embodiments illustrated in FIGS. 1A-C, the outer housing 24 may have a generally cylindrical cross-section. In some example embodiments, the outer housing 24 may have a generally triangular cross-section along one or more of the pre-vapor formulation tank section 70 and the power supply section 72. In some example embodiments, the outer housing 24 may have a greater circumference or dimensions at a tip end than at an outlet end of the e-vaping device 60.

The inner tube 25 may define at least a portion of a channel 28 through the pre-vapor formulation tank 22. The tip end of the inner tube 25 may define opening 50*a* at a tip portion (or "first portion") of channel 28. As shown in FIG. 1B, the outlet end of the inner tube 25 is coupled with the gasket assembly 51 to define an opening 50*b* at an outlet portion (or "second portion") of the channel 28. In some example embodiments, the inner tube 25 extends through the gasket assembly 51 to define the outlet portion of the channel 28. In some example embodiments, the gasket assembly 51 includes a channel 51*c*. In the example embodiments illustrated in FIG. 1B, the outlet end of the inner tube 25 extends through the gasket assembly channel 51*c* to define the outlet portion of channel 28 and opening 50*b* of channel 28.

In some example embodiments, the gasket assembly 51 may couple with the inner tube 25 such that the gasket assembly channel 51*c* and the inner tube 25 define the separate portions of the channel 28 and the gasket assembly channel 51*c* defines both the opening 50*b* and the outlet portion of the channel 28.

In some example embodiments, the pre-vapor formulation tank 22 includes a pre-vapor formulation reservoir in the form of a reservoir 23. In some example embodiments, including the example embodiments illustrated in FIGS. 1A-C, pre-vapor formulation tank 22 includes an annular reservoir 23. The reservoir 23 is defined by the inner surface of the outer housing 24, the outer surface of the inner tube 25, the gasket assembly 51 at the outlet end of the pre-vapor formulation tank 22, and a gasket assembly 8 included in the adaptor 90 coupled to the outer housing 24 and inner tube 25 via connector elements 12*a* and 15, respectively.

Gasket assembly 51 is coupled to outlet ends of the outer housing 24 and the inner tube 25, respectively, to define an outlet end of the reservoir 23. As shown in FIG. 1B, the gasket assembly 51 includes a channel 51*c* that may define an outlet portion of the channel 28 that extends through the gasket assembly 51.

In the example embodiments shown in FIGS. 1A-C, the reservoir 23 is an annulus positioned around a central air channel 28. The channel 28 is at least partially defined by the inner surface of the inner tube 25. The channel 28 may provide an opening for access to an interior of pre-vapor formulation tank 22 for adding a pre-vapor formulation to the reservoir 23. The pre-vapor formulation tank 22 may be refillable via a reservoir opening using any commercially-available pre-vapor formulation in order to continually reuse pre-vapor formulation tank 22. In some example embodiments, the reservoir opening is included in the gasket assembly 51. and enables access to the reservoir 23 from an exterior of the pre-vapor formulation tank 22 through the gasket assembly 51.

At least a portion of pre-vapor formulation tank 22 may have a transparent wall to enable manual observation and monitoring of an amount of pre-vapor formulation in the reservoir 23. For example, at least a portion of the outer housing 24 may be a transparent material, translucent material, some combination thereof, or the like. At least a portion of the inner tube 25 may be a transparent material, translucent material, some combination thereof, or the like. As shown in FIGS. 1A-C, the outer housing 24 may include a set of graduation marks 71 that may provide a visually-observable indication of an amount of pre-vapor formulation held within the reservoir 23.

As shown in FIG. 1C, the pre-vapor formulation tank 22 may include a reservoir opening 50*d* that is defined between the tip ends of the outer housing 24 and the inner tube 25, respectively. As shown in FIG. 1C, the reservoir opening 50*d*. may be an annulus opening extending around channel 28 defined by the inner tube 25. The reservoir opening 50*d* may provide an opening for an adult vaper to access an interior of pre-vapor formulation tank 22 and add one or more pre-vapor formulations into the reservoir 23. Such adding may include decoupling the pre-vapor formulation tank 22 and adaptor 90, adding pre-vapor formulation to the reservoir 23 through opening 50*d*, and re-coupling the pre-vapor formulation tank 22 and adaptor 90 together.

The gasket assembly 51 includes one or more connector elements 52 configured to couple a flavor insert 80 to the e-vaping device 60 if and/or when the flavor insert 80 is inserted through the passage of the gasket assembly 51 to position the flavor insert 80 at an outlet end of the channel 28. In some example embodiments, a connector element 52 extends around an inner surface of the channel 28.

The pre-vapor formulation tank 22 may include a connector element 29 at the tip end of outer housing 24. Connector element 29 is configured to couple with connector element 12*a* of adaptor 90. The tip end of the inner tube 25 may be configured to couple with a connector element 15 of adaptor 90. As shown, one or more of the outer housing 24 and inner tube 25 may include a separately formed, self-supporting (discrete) hollow body constructed of a heat-resistant plastic or woven fiberglass.

Still referring to FIGS. 1A-C, adapter 90 includes a gasket assembly 8, dispensing interface 32, heating element 34, and interface 74. As shown, the adaptor 90 further includes a connector element 91 and electrical leads 36-1 and 36-2. The electrical leads 36-1 and 36-2 couple the heating element 34 to interface 74 and connector element 91, respectively.

The connector element 91 may include an insulating material 91*b* and a conductive material 91*a*. The conductive material 91*a* may electrically couple lead 36-2 to power supply 12, and the insulating material 9 lb may insulate the conductive material 91*a* from the interface 74, such that a probability of an electrical short between the lead 36-2 and the interface 74 is reduced and/or prevented. For example, if and/or when the connector element 91 includes a cylindrical cross-section orthogonal to a longitudinal axis of the e-vaping device 60, the insulating material 91*b* included in connector element 91 may be in an outer annular portion of the connector element 91 and the conductive material 91*a* may be in an inner cylindrical portion of the connector element 91, such that the insulating material 91*b* surrounds the conductive material 91*a* and reduces and/or prevents a probability of an electrical connection between the conductive material 91*a* and the interface 74.

The gasket assembly 8 includes a nose portion 30 that is configured to couple with a tip end of inner tube 25. The gasket assembly 8 includes a channel 14 that extends through the nose portion 30 and opens into an interior of the inner tube 25 that defines a tip portion of channel 28.

Adaptor 90 includes an interior space 10 at a backside portion of the gasket assembly 8. The space 10 is defined by an outer housing 38 of the adaptor 90, interface 74, gasket assembly 8, and the connector element 91. The space 10 assures communication between the channel 14 and one or more air inlet ports 44 located between the gasket assembly 8 and a connector element 91. The connector element 91 may be included in the interface 74.

In some example embodiments, at least one air inlet port 44 may be formed in the outer housing 38, adjacent to the interface 74 to minimize the probability of an adult vaper's fingers occluding one of the air inlet ports 44 and to control the resistance-to-draw (RTD) during vaping. In some example embodiments, the air inlet ports 44 may be machined into the outer housing 38 with precision tooling such that their diameters e closely controlled and replicated from one e-vaping device 60 to the next during manufacture.

In some example embodiments, the air inlet ports 44 may be drilled with carbide drill bits or other high-precision tools and/or techniques. In some example embodiments, the outer housing 38 may be formed of metal or metal alloys such that the size and shape of the air inlet ports 44 may not be altered during manufacturing operations. packaging, and vaping. Thus, the air inlet ports 44 may provide consistent RTD. In sonic example embodiments, the air inlet ports 44 may be sized and configured such that the e-vaping device 60 has a RTD in the range of from about 60 mm $H_2O$ to about 150 mm $H_2O$.

As shown in FIG. 1B, the gasket assembly 8 is configured to define a tip end of the reservoir 23 if and/or when the adaptor 90 is coupled to the pre-vapor formulation tank 22 through connector elements 12*a* and 15, Gasket assembly 8 includes a connector element 15 coupled to an inner surface of the channel 14. The connector element 15 may couple the tip end of the inner tube 25 to the gasket assembly 8 to seal or substantially seal the reservoir 23 from the space 10 and channels 14, 28.

The gasket assembly 8 includes a dispensing interface 32 configured to draw pre-vapor formulation from the reservoir 23, and a heating element 34 configured to vaporize the drawn pre-vapor formulation to form a vapor 95. The dispensing interface 32 and the heating element 34 may be collectively referred to as a vaporizer assembly.

The dispensing interface 32 is coupled to the gasket assembly 8, such that the dispensing interface 32 may extend transversely across the channel 14. In the example embodiments illustrated in FIG. 1B, the dispensing interface 32 is coupled to the nose portion 30 and extends through the channel 14 in the nose portion 30.

The dispensing interface 32 may include one or more ends that protrude through side portions of the gasket assembly 8, such that the one or more ends of the dispensing interface 32 may be exposed to an interior of the reservoir 23 if and/or when the adaptor 90 is coupled to the pre-vapor formulation tank 22. The one or more ends of the dispensing interface 32 may be submerged in a pre-vapor formulation held within the reservoir 23. In the example embodiments illustrated in FIG. 1B, for example, the adaptor 90 includes a dispensing interface 32 that is coupled to the nose portion 30 of the gasket assembly 8 such that a central portion ("trunk") of the dispensing interface 32 extends through the channel 14 and end portions ("roots") of the dispensing interface 32 extend from separate exterior surfaces of the nose portion 30. As shown in FIG. 1B, the end portions of the dispensing interface 32 are positioned within the reservoir 23 if and/or when the adaptor 90 and pre-vapor formulation tank 22 are coupled together, such that the dispensing interface 32 is configured to draw pre-vapor formulation from the reservoir 23.

The heating element 34 is coupled to the dispensing interface 32 and is configured to generate heat. As shown in the example embodiment illustrated in. FIG. 1B, the heating element 34 may extend transversely across the channel 14 between opposing portions of the gasket assembly 8. In some example embodiments, the heating element 34 may extend parallel to a longitudinal axis of the channel 14.

The dispensing interface 32 is configured to draw pre-vapor formulation from the reservoir 23, such that the pre-vapor formulation may be vaporized from the dispensing interface 32 based on heating of the dispensing interface 32 by the heating element 34.

During vaping, pre-vapor formulation may be transferred from the reservoir 23 and/or storage medium in the proximity of the heating element 34 via capillary action of a dispensing interface 32. The heating element 34 may at least partially surround a central portion ("trunk") of the dispensing interface 32 such that when the heating element 34 is activated to generate heat, the pre-vapor formulation in the central portion of the dispensing interface 32 may be vaporized by the heating element 34 to form a vapor 95.

Still referring to FIGS. 1A-C, the adaptor 90 includes a connector element 91. Connector element 91 may include one or more of a cathode connector element and an anode connector element. In the example embodiment illustrated in FIG. 1B, for example, electrical lead 36-2 is coupled to the connector element 91. As further shown in FIG. 1B, the connector element 91 is configured to couple with a power supply 12 included in the power supply section 72. If and/or when interfaces 74, 84 are coupled together, the connector element 91 and power supply 12 may be coupled together. Coupling connector element 91 and power supply 12 together may electrically couple electrical lead 36-2 and power supply 12 together.

In some example embodiments, one or more of the interfaces 74, 84 include one or more of a cathode connector element and an anode connector element. In the example embodiment illustrated in FIG. 1B, for example, electrical lead 36-1 is coupled to the interface 74. As further shown in FIG. 1B, the power supply section 72 includes a lead 92 that couples the control circuitry 11 to the interface 84. If and/or when interfaces 74, 84 are coupled together, the coupled interfaces 74, 84 may electrically couple electrical leads 36-1 and 92 together.

If and/or when interfaces 74, 84 are coupled together, one or more electrical circuits through the pre-vapor formulation tank section 70 and power supply section 72 may be established. The established electrical circuits may include at least the heating element 34, the control circuitry 11, and the power supply 12. The electrical circuit may include electrical leads 36-1 and 36-2, lead 92, and interfaces 74, 84.

Still referring to FIGS. 1A-C, the reservoir 23 may include a pre-vapor formulation that is free of flavorants, such that when the heating element 34 vaporizes pre-vapor formulation in the dispensing interface 32 to form a vapor 95, the vapor 95, also referred to herein as a "generated vapor," may be substantially absent of flavor. Such an absence of flavorants in the pre-vapor formulation held in the reservoir 23 may result in mitigation of chemical reactions between pre-vapor formulation materials and the flavorants in the reservoir 23 and upon vaporization as a result of heating of the pre-vapor formulation by the heating element 34.

E-vaping device 60 includes a flavor insert 80 that is configured to be coupled to the pre-vapor formulation tank section 70 such that the flavor insert 80 is positioned at the outlet portion of the channel 28 and is configured to receive the vapor 95 passing through the channel 28. The pre-vapor formulation tank section 70 is configured to position the flavor insert 80 and the vaporizer assembly (comprising the dispensing interface 32 and heating element 34) at opposite ends of the channel 28. As shown in FIG. 1B, for example, the dispensing interface 32 and heating element 34 are proximate to the opening 50*a* at the tip portion of channel 28, In addition, the flavor insert 80 is proximate to the opening Sob at the outlet portion of the channel 28.

As shown in FIG. 1B, the flavor insert 80 may include a containment structure 82 enclosing an interior of the flavor insert 80. The flavor insert 80 may include a flavor material 85. The flavor material 85 may include one or more flavorants. The flavor insert 80 may include one or more filter elements 86 configured to filter one or more types of particulate matter from a vapor passing through the interior of the flavor insert 80.

As used herein, the term "flavorant" is used to describe a compound or combination of compounds that may provide flavor and/or aroma to an adult vaper. In some example embodiments, a flavorant is configured to interact with at least one adult vaper sensory receptor. A flavorant may be configured to interact with the sensory receptor via at least one of orthonasal stimulation and retronasal stimulation. A flavorant may include one or more volatile flavor substances.

The at least one flavorant may include one or more of a natural flavorant or an artificial ("synthetic") flavorant. The at least one flavorant may include one or more plant extract materials. In some example embodiments, the at least one flavorant is one or more of tobacco flavor, menthol, wintergreen, peppermint, herb flavors, fruit flavors, nut flavors, liquor flavors, and combinations thereof. In some example embodiments, the flavorant is included in a botanical material. A botanical material may include material of one or more plants. A botanical material may include one or more herbs, spices, fruits, roots, leaves, grasses, or the like. For example, a botanical material may include orange rind material and sweetgrass material. In another example, a botanical material may include tobacco material. In some example embodiments, a flavorant that is a tobacco flavor (a "tobacco flavorant") includes at least one of a synthetic material and a plant extract material. A plant extract material included in a tobacco flavorant may be an extract from one or more tobacco materials.

In some example embodiments, a tobacco material may include material from any member of the genus *Nicotiana*. In some example embodiments, the tobacco material includes a blend of two or more different tobacco varieties. Examples of suitable types of tobacco materials that may be used include, but are not limited to, flue-cured tobacco, Burley tobacco, Dark tobacco, Maryland tobacco, Oriental tobacco, rare tobacco, specialty tobacco, blends thereof and the like. The tobacco material may be provided in any suitable form, including, but not limited to, tobacco lamina, processed tobacco materials, such as volume expanded or puffed tobacco, processed tobacco stems, such as cut-rolled or cut-puffed stems, reconstituted tobacco materials, blends thereof, and the like. In some example embodiments, the tobacco material is in the form of a substantially dry tobacco mass.

In some example embodiments, a flavor insert 80 that includes a tobacco flavor material 85 is referred to as a tobacco element. In some example embodiments, the flavor insert 80 is a tobacco rod that holds a flavor material 85 that is one or more types of tobacco (also referred to as a tobacco flavor material 85). The tobacco rod 80 may be configured to be at least partially combusted such that at least a portion of the tobacco flavor material 85 is combusted and directed out of an end of the tobacco rod 80. A tobacco rod 80 may include one or more of a cigarette, cigar, cigarillo, some combination thereof, or the like. The tobacco rod 80 may include a filter element 86 that is configured to filter one or more instances of particular matter from a vapor that includes one or more products of combustion of at least the tobacco flavor material 85.

In some example embodiments, at least the pre-vapor formulation tank section 70 is a non-combustible vaping element that is configured to form at least a generated vapor 95. The non-combustible vaping element 70 may direct the generated vapor 95 through the channel 28 and through a tobacco rod 80 positioned at the outlet portion of channel 28 such that one or more flavorants are eluted from a tobacco flavor material 85 of the tobacco rod 80 into the generated vapor 95 to form a flavored vapor 97. The non-combustible vaping element 70 is configured to enable such elution independently of any combustion of the tobacco flavor material 85.

In some example embodiments, the generated vapor 95 may be at an elevated temperature, relative to a temperature of the flavor material 85. If and/or when the generated vapor 95 passes through the flavor insert 80, the generated vapor 95 may transfer heat to the flavor material 85. In some example embodiments, flavorant elution from the flavor material 85 to the generated vapor 95 may be improved based on the heating of the flavor material 85 by the generated vapor 95. Based on an improved elution of flavorant into the generated vapor 95, a flavored vapor 97 may include an increased amount of eluted flavorant, relative to example embodiments where the flavor material 85 is unheated, and a sensory experience provided by the e-vaping device may thereby be improved.

As shown in the illustrated embodiments of FIGS. 1A-C, the flavor insert 80 may be inserted through opening Sob into the channel 28 such that the flavor insert 80 is coupled with the one or more connector elements 52 therein. The connector elements 52 may form an airtight or substantially airtight seal between a containment structure 82 of the flavor insert 80 and an inner surface of the channel 28, such that vapor 95 passing through the channel 28 is directed to exit the e-vaping device 60 through an interior of the flavor insert 80.

In some example embodiments, one or more connector elements 52 are absent, and the flavor insert 80 containment structure 82 forms an airtight or substantially airtight seal with an inner surface of the channel 28 if and/or when the flavor insert 80 is inserted into the channel 28. The inner surface of the channel 28 may be configured to form a friction fit with the containment structure 82 of the flavor insert 80 to couple the flavor insert 80 with the pre-vapor formulation tank section 70 and to hold the flavor insert 80 in place at the outlet portion of the channel 28.

In some example embodiments, the flavor insert 80 may be removably coupled with the channel 28, such that one or more flavor inserts 80 may be swapped from the e-vaping device 60. In some example embodiments, the flavor insert 80 may be referred to as a detachable insert.

As shown in FIG. 1B, the flavor insert 80 that is positioned at the outlet end of the channel 28 through opening 50*b* is positioned in flow communication with the channel 14 in which the central portion of the dispensing interface 32 and the heating element 34 coupled thereto are located. The channel 28 may be configured to direct generated vapors 95 formed in the channel 14 to exit the pre-vapor formulation tank section 70 via an interior of the flavor insert 80 at the outlet end of the channel 28.

The flavor material 85 may be a porous structure that includes one or more instances of flavor material 85. The porous structure lay hold a flavorant in flow communication with the channel 28 so that generated vapors 95 formed in the pre-vapor formulation tank section 70, received at the flavor insert 80 via the channel 28, and passing through the flavor insert 80 may pass at least partially through the porous structure and in flow communication with the flavorants held by the porous structure. The generated vapor 95 may act as an eluent, eluting the flavorant from the flavor insert 80 and into the generated vapor 95 to form an eluate. The eluate may include the generated vapor 95 and the flavorant. Such an eluate may be referred to as the flavored vapor 97.

In some example embodiments, the flavorants eluted into the generated vapor 95 are in a particulate phase. A particulate phase may include a liquid phase, solid phase, or the like. In some example embodiments, the flavorants eluted into the generated vapor 95 are in a vapor phase, gas phase, etc. A flavorant may include a volatile flavor substance, and the volatile flavor substance may be eluted into the generated vapor. In some example embodiments, a flavorant eluted into the generated vapor 95 includes a nonvolatile flavor substance.

In some example embodiments, if and/or when the flavor insert 80 holds the flavorant separate from the pre-vapor formulation tank section 70 and the pre-vapor formulation tank section 70 is configured to direct generated vapors 95 through the flavor insert 80 subsequent to formation of the generated vapor 95, the generated vapor 95 may be cooled from an initial temperature at channel 14. Where the generated vapor 95 passing through the flavor insert 80 is cooled from the initial temperature, chemical reactions between the flavorants eluted into the generated vapor 95 and the elements of the generated vapor 95 may be at least partially mitigated, thereby mitigating a loss of desired flavor in the flavored vapor 97.

In some example embodiments, a flavor insert 80 is configured to cool a generated vapor 95 passing through the flavor insert 80. The flavor insert 80 may cool a raw vaper 95 based on heat transfer from the generated vapor 95 to at least one of the flavorant eluted into the generated vapor 95 and a material included in the flavor insert 80. In some example embodiments, the transfer of heat from a generated vapor 95 into at least one of the flavorant and a material included in the flavor insert 80 increases the amount of flavorant eluted into the generated vapor 95. A flavored vapor 97 having an increased amount of eluted flavorant may provide an improved sensory experience. In some example embodiments, a flavored vapor 97 exiting the flavor insert 80 may be cooler than a generated vapor 95 entering the flavor insert 80. A flavored vapor 97 that is cooler than the generated vapor entering the flavor insert 80 may provide an improved sensory experience based on the reduced temperature of the flavored vapor 97.

In some example embodiments, the flavorants included in an e-vaping device 60 may be replaceable independently of the pre-vapor formulation in the pre-vapor formulation tank section 70, as the flavorants are included in a flavor insert 80 that is separate from the pre-vapor formulation tank section 70 in which the pre-vapor formulation is included. The flavor insert 80 may be replaced with another flavor insert 80 to swap the flavorant included in the e-vaping device 60 as desired by an adult vaper. The flavor insert 80 may be replaced with another flavor insert 80 to replenish flavorants in the e-vaping device 60 without replacing pre-vapor formulation tank section 70 and/or pre-vapor formulation held therein, where the reservoir 23 may include sufficient pre-vapor formulation to support additional vaping.

Still referring to FIG. 1A and FIG. 1B, the power supply section 72 includes an outer housing 17 extending in a longitudinal direction, a sensor 13 responsive to air drawn into the power supply section 72 via an air inlet port 44*a* adjacent to a free end or tip end of the e-vaping device 60, at least one power supply 12, and control circuitry 11. The power supply 12 may include a rechargeable battery. The sensor 13 may be one or more of a pressure sensor, a microelectromechanical system (MEMS) sensor, etc.

In some example embodiments, the power supply 12 includes battery arranged in the e-vaping device 60 such that the anode is downstream the cathode. A connector element 91 contacts the downstream end of the battery. The heating element 34 may be coupled to the power supply 12 by at least the two spaced apart electrical leads 36-1 and 36-2, the interfaces 74, 84, the connector element 91, electrical lead 92, and control circuitry 11.

The power supply 12 may be a Lithium-ion battery or one of its variants, for example a Lithium-ion polymer battery. Alternatively, the power supply 12 may be a nickel-metal hydride battery, a nickel cadmium battery, a lithium-manganese battery, a lithium-cobalt battery or a fuel cell. The e-vaping device 60 may be usable by an adult vesper until the energy in the power supply 12 is depleted or in the case of lithium polymer battery, a minimum voltage cut-off level is achieved.

Further, the power supply 12 may be rechargeable and may include circuitry configured to allow the battery to be chargeable by an external charging device. To recharge the e-vaping device 60, a Universal Serial Bus (USB) charger or other suitable charger assembly may be used.

Upon completing the connection between the pre-vapor formulation tank section 70 and the power supply section 72, the at least one power supply 12 may be electrically connected with the heating element 34 of the pre-vapor formulation tank section 70 upon actuation of the sensor 13. Air is drawn primarily into the pre-vapor formulation tank section 70 through one or more air inlet ports 44. The one or more air inlet ports 44 may be located along the outer housing 38, 17 of the first and second sections 70, 72 or at one or more of the coupled interfaces 74, 84.

The sensor 13 may be configured to sense an air pressure drop and initiate application of voltage from the power supply 12 to the heating element 34. As shown in the example embodiment illustrated in FIG. 1B, some example embodiments of the power supply section 72 include a heater activation light 48 configured to glow when the heating element 34 is activated. The heater activation light 48 may include a light emitting diode (LED). Moreover, the heater activation light 48 may be arranged to be visible to an adult vaper during vaping. In addition, the heater activation light 48 may be utilized for e-vaping system diagnostics or to indicate that recharging is in progress. The heater activation light 48 may also be configured such that the adult vaper may activate and/or deactivate the heater activation light 48 for privacy. As shown in FIGS. 1A-C, the heater activation light 48 may be located on the tip end of the e-vaping device 60. In some example embodiments, the heater activation light 48 may be located on a side portion of the outer housing 17.

In addition, the at least one air inlet port 44*a* may be located adjacent to the sensor 13, such that the sensor 13 may sense air flow indicative of vapor being drawn through the outlet end of the e-vaping device 60. The sensor 13 may activate the power supply 12 and the heater activation light 48 to indicate that the heating element 34 is activated.

In some example embodiments, the control circuitry 11 may control the supply of electrical power to the heating element 34 responsive to the sensor 13. In some example embodiments, the control circuitry 11 may include a maximum, time-period limiter. In some example embodiments, the control circuitry 11 may include a manually operable switch for an adult vapor to manually initiate vaping. The time-period of the electric current supply to the heating element 34 may be pre-set depending on the amount of pre-vapor formulation desired to be vaporized. In some example embodiments, the control circuitry 11 may control the supply of electrical power to the heating element 34 as long as the sensor 13 detects a pressure drop.

To control the supply of electrical power to a heating element 34, the control circuitry 11 may execute one or more instances of computer-executable program code. The control circuitry 11 may include a processor and a memory. The memory may be a computer-readable storage medium storing computer-executable code.

The control circuitry 11 may include processing circuitry including, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. In some example embodiments, the control circuitry 11 may be at least one of an application-specific integrated circuit (ASIC) and an ASIC chip.

The control circuitry 11 may be configured as a special purpose machine by executing computer-readable program code stored on a storage device. The program code may include program or computer-readable instructions, software elements, software modules, data files, data structures, and/or the like, capable of being implemented by one or more hardware devices, such as one or more instances of the control circuitry 11 mentioned above. Examples of program code include both machine code produced by a compiler and higher level program code that is executed using an interpreter.

The control circuitry 11 may include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a USB flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The control circuitry 11 may be a special purpose machine configured to execute the computer-executable code to control the supply of electrical power to the heating element 34. Controlling the supply of electrical power to the heating element 34 may be referred to herein interchangeably as activating the heating element 34.

The pre-vapor formulation is a material or combination of materials that may be transformed into a vapor. For example, the pre-vapor formulation may be a liquid, solid and/or gel formulation including, but not limited to, water, beads, solvents, active ingredients, ethanol, plant extracts, natural or artificial flavors, and/or vapor formers such as glycerin and propylene glycol. The pre-vapor formulation may include those described in U.S. Patent Application Publication No. 2015/0020823 to Lipowicz et al. filed Jul. 16, 2014 and U.S. Patent Application Publication No. 2015/0313275 to Anderson et al. filed Jan. 21, 2015, the entire contents of each of which is incorporated herein by reference thereto.

In some example embodiments, the pre-vapor formulation is one or more of propylene glycol, glycerin and combinations thereof.

The pre-vapor formulation may include nicotine or may exclude nicotine. The pre-vapor formulation may include one or more tobacco flavors. The pre-vapor formulation may include one or more flavors that are separate from one or more tobacco flavors.

in some example embodiments, a pre-vapor formulation that includes nicotine may also include one or more acids. The one or more acids may be one or more of pyruvic acid, formic acid, oxalic acid, glycolic acid, acetic acid, isovaleric acid, valeric acid, propionic acid, octanoic acid, lactic acid, levulinic acid, sorhic acid, malic acid, tartaric acid, succinic acid, citric acid, benzoic acid, oleic acid, aconitic acid, butyric acid, cinnamic acid, decanoic acid, 3,7-dimethyl-6-octenoic acid, 1-glutamic acid, heptanoic acid, hexanoic acid, 3-hexenoic acid, trans-2-hexenoic acid, isobutyric acid, lauric acid, 2-methylbutyric acid, 2-methylvaleric acid, myristic acid, nonanoic acid, palmitic acid, 4-penenoic acid, phenylacetic acid, 3-phenylpropionic acid, hydrochloric acid, phosphoric acid, sulfuric acid and combinations thereof.

The reservoir 23, in some example embodiments, may include a storage medium that may hold the pre-vapor formulation. The storage medium may be a fibrous material including at least one of cotton, polyethylene, polyester, rayon and combinations thereof. The fibers may have a diameter ranging in size from about 6 microns to about 15 microns (e.g., about 8 microns to about 12 microns or about 9 microns to about 11 microns). The storage medium may be a sintered, porous or foamed material. Also, the fibers may be sized to be irrespirable and may have a cross-section that has a Y-shape, cross shape, clover shape or any other suitable shape. In some example embodiments, the reservoir 23 may include a filled tank lacking any storage medium and containing only pre-vapor formulation.

The reservoir 23 may be sized and configured to hold enough pre-vapor formulation such that the e-vaping device 60 may be configured for vaping for at least about 200 seconds. The e-vaping device 60 may be configured to allow each vaping to last a maximum of about 5 seconds.

The dispensing interface 32 may include a wick. The dispensing interface 32 may include filaments (or threads) having a capacity to draw the pre-vapor formulation. For example, a dispensing interface 32 may be a wick that is a bundle of glass (or ceramic) filaments, a bundle including a group of windings of glass filaments, etc., all of which arrangements may be capable of drawing pre-vapor formulation via. capillary action by interstitial spacings between the filaments. The filaments may be generally aligned in a direction perpendicular (transverse) to the longitudinal direction of the e-vaping device 60. In some example embodiments, the dispensing interface 32 may include one to eight filament strands, each strand comprising a plurality of glass filaments twisted together. The end portions of the dispensing interface 32 may be flexible and foldable into the confines of the reservoir 23. The filaments may have a cross-section that is generally cross-shaped, clover-shaped, Y-shaped, or in any other suitable shape.

The dispensing interface 32 may include any suitable material or combination of materials, also referred to herein as wicking materials. Examples of suitable materials may be, but riot limited to, glass, ceramic- or graphite-based materials. The dispensing interface 32 may have any suitable capillary drawing action to accommodate pre-vapor formulations having different physical properties such as density, viscosity, surface tension and vapor pressure.

In some example embodiments, the heating element 34 may include a wire coil. The wire coil may at least partially surround the dispensing interface 32 in the channel 14. The wire may be a metal wire and/or the wire coil may extend fully or partially along the length of the dispensing interface 32. The wire coil may further extend fully or partially around the circumference of the dispensing interface 32. In some example embodiments, the wire coil may be isolated from direct contact with the dispensing interface 32.

The heating element 34 may be formed of any suitable electrically resistive materials. Examples of suitable electrically resistive materials may include, but not limited to, titanium, zirconium, tantalum and metals from the platinum group. Examples of suitable metal alloys include, but not limited to, stainless steel, nickel, cobalt, chromium, aluminum-titanium-zirconium, hafnium, niobium, molybdenum, tantalum, tungsten, tin, gallium, manganese and iron-containing alloys, and super-alloys based on nickel, iron, cobalt, stainless steel. For example, the heating element 34 may be formed of nickel aluminide, a material with a layer of alumina on the surface, iron aluminide and other composite materials, the electrically resistive material may optionally be embedded in, encapsulated or coated with an insulating material or vice-versa, depending on the kinetics of energy transfer and the external physicochemical properties required. The heating element 34 may include at least one material selected from the group consisting of stainless steel, copper, copper alloys, nickel-chromium alloys, super alloys and combinations thereof. In some example embodiments, the heating element 34 may be formed of nickel-chromium alloys or iron-chromium alloys. In some example embodiments, the heating element 34 may be a ceramic heater having an electrically resistive layer on an outside surface thereof.

The heating element 34 may heat a pre-vapor formulation in the dispensing interface 32 by thermal conduction. Alternatively, heat from the heating element 34 may be conducted to the pre-vapor formulation by means of a heat conductive element or the heating element 34 may transfer heat to the incoming ambient air that is drawn through the e-vaping device 60 during vaping, which in turn heats the pre-vapor formulation by convection.

It should be appreciated that, instead of using a dispensing interface 32, the pre-vapor formulation tank section 70 may include a heating element 34 that is a porous material which incorporates a resistance heater formed of a material having a high electrical resistance capable of generating heat quickly.

In some example embodiments, one or more portions of the pre-vapor formulation tank section 70 may be replaceable. Such one or more portions may include one or more of the pre-vapor formulation tank 22, the adaptor 90, and the tobacco element 80. In other words, once one of the flavorant of the flavor insert 80 or the pre-vapor formulation of the pre-vapor formulation tank section 70 is depleted, only the flavor insert 80 or the pre-vapor formulation tank section 70 may be replaced, respectively. In some example embodiments, the entire e-vaping device 60 may be disposed once one of the reservoir 23 or the flavor insert 80 is depleted.

In some example embodiments, the e-vaping device 60 may be about 80 mm to about 110 mm long and about 7 mm to about 8 mm in diameter. For example, in some example embodiments, the e-vaping device 60 may be about 84 mm long and may have a diameter of about 7.8 mm.

In some example embodiments, if and/or when the e-vaping device 60 includes a flavor insert 80 that holds a flavorant separate from the pre-vapor formulation tank 22, the e-vaping device 60 may be configured to mitigate a probability of chemical reactions between the flavorant and one or more elements of the pre-vapor formulation tank 22. Such chemical reactions may include chemical reactions between one or more portions of the flavorant. An absence of such chemical reactions may result in an absence of reaction products in the flavored vapor 97. Such reaction products may detract from a sensory experience provided by the flavored vapor 97. As a result, an e-vaping device 60 that is configured to mitigate the probability of such chemical reactions may provide a more consistent and improved sensory experience through the flavored vapor 97.

In some example embodiments, the flavorants included in an e-vaping device 60 may be replaceable independently of the pre-vapor formulation in the pre-vapor formulation tank section 70. The flavorants are included in a flavor insert 80 that is separate from the pre-vapor formulation tank section 70 in which the pre-vapor formulation is included. The flavor insert 80 may be replaced with another flavor insert 80 to swap the flavorant included in the e-vaping device 60 as desired by an adult vaper. The flavor insert 80 may be replaced with another flavor insert 80 to replenish flavorants in the e-vaping device 60 without replacing a pre-vapor formulation tank section 70, pre-vapor formulation, etc., where the pre-vapor formulation tank section 70, 22 may include sufficient pre-vapor formulation to support additional vaping.

Still referring to FIG. 1A and FIG. 1B, when the heating element 34 is activated, the activated heating element 34 may heat a portion of a dispensing interface 32 surrounded by the heating element 34 for less than about 10 seconds. Thus, the power cycle (or maximum vaping length) may range in period from about 2 seconds to about 10 seconds (e.g., about 3 seconds to about 9 seconds, about 4 seconds to about 8 seconds or about 5 seconds to about 7 seconds).

Figure 2A:
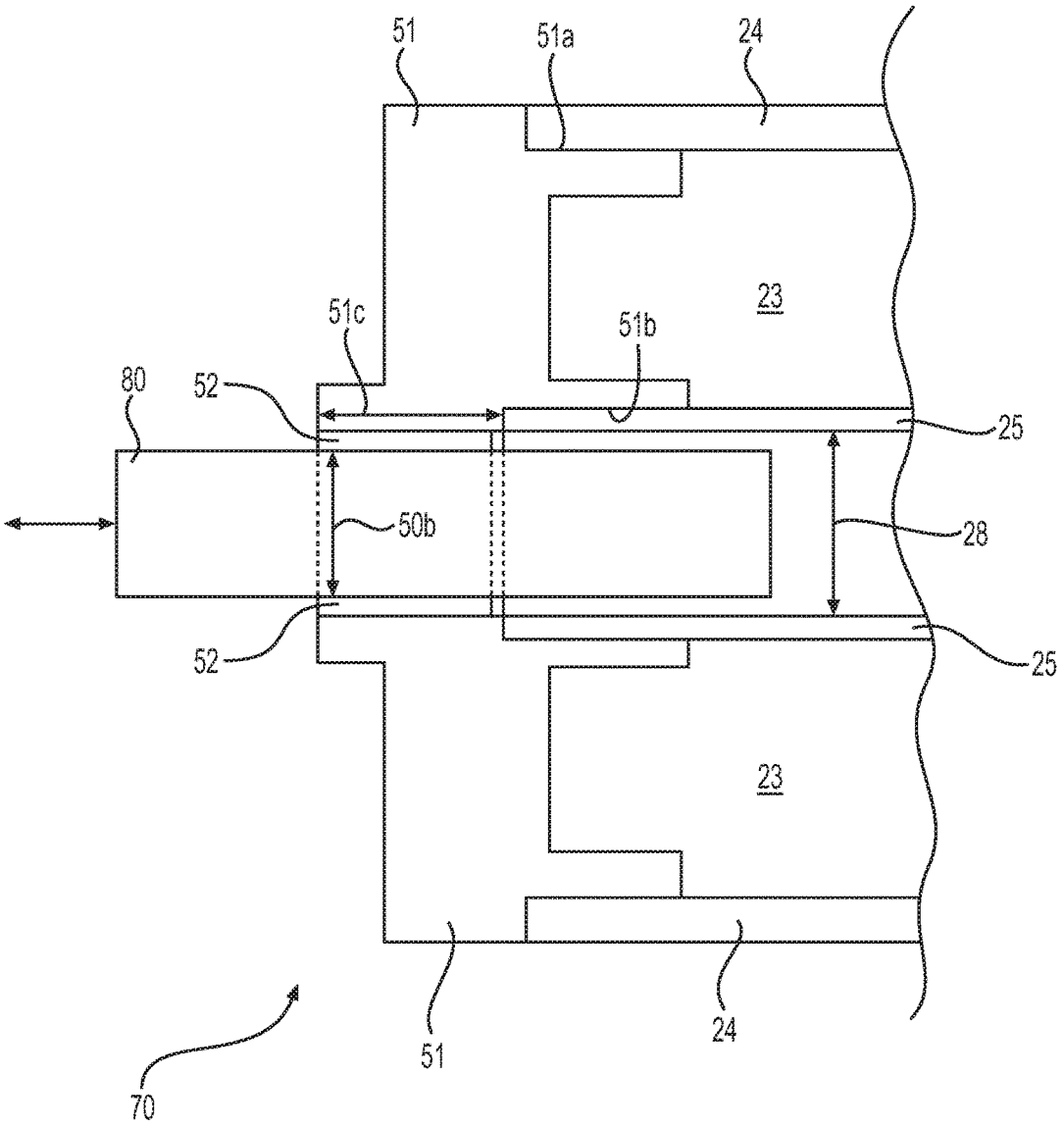
FIG. 2A is a cross-sectional view of a pre-vapor formulation tank section according to some example embodiments.
Figure 2B:
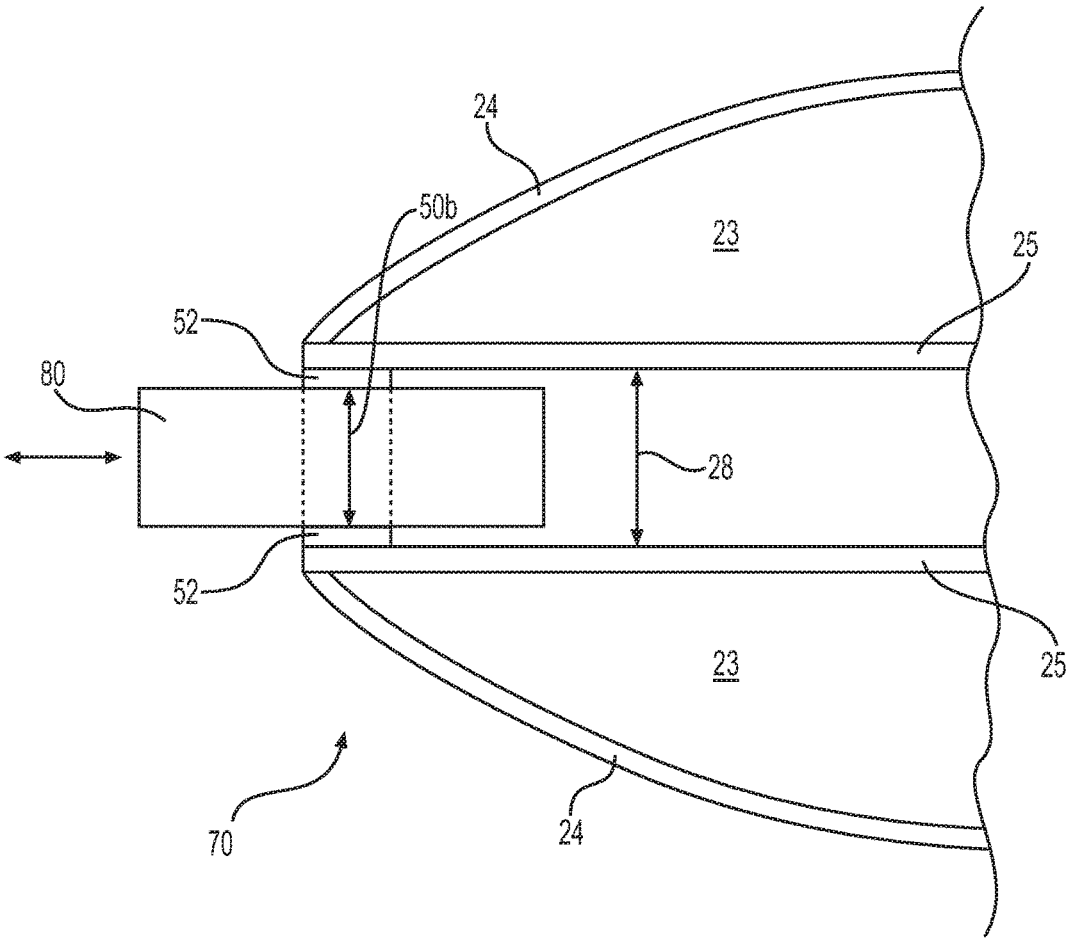
FIG. 2B is a cross-sectional view of a pre-vapor formulation tank section according to some example embodiments.

FIG. 2A is a cross-sectional view of a pre-vapor formulation tank section 70 according to some example embodiments. FIG. 2B is a cross-sectional view of a pre-vapor formulation tank section 70 according to some example embodiments. The example embodiments of pre-vapor formulation tank sections 70 shown in FIG. 2A and FIG. 2B may be included in any of the example embodiments included herein, including the pre-vapor formulation tank section 70 shown in FIGS. 1A-C.

Referring to FIG. 2A, in some example embodiments, a pre-vapor formulation tank section 70 includes a pre-vapor formulation tank 22 that further includes an outer housing 24, an inner tube 25, and a gasket assembly 51 that at least partially define a reservoir 23 that may hold pre-vapor formulation. The inner tube 25 at least partially defines the channel 28 through the interior of the pre-vapor formulation tank 22.

Gasket assembly 51 includes connector elements 51*a* and 51*b* that couple with the outer housing 24 and the inner tube 25, respectively, to define an outlet end of the reservoir 23. In the example embodiments illustrated in FIG. 2A, the gasket assembly 51 is a disc-shaped assembly that includes a channel 51*c* extending through an inner portion of the disc-shaped assembly from opening 50*b*. As shown, the disc-shaped assembly of gasket assembly 51 may include connector elements 51*b* that at least partially define an opening of the channel 51*c* that is opposite to opening 50*b*, such that the connector elements 51*b* are configured to couple inner tube 25 to channel 51*c*. The disc-shaped assembly of gasket assembly 51 may include connector elements 51*a* that define at least a portion of the outer boundary of the gasket assembly 51, such that the connector elements 51*a* are configured to couple outer housing 24 to the outer boundary of the gasket assembly 51. Thus, if and/or when the gasket assembly 51 is a disc-shaped assembly, the gasket assembly may cooperate with the inner tube 25 and the outer housing 24 to define an end of an annular cylindrical reservoir 23 that is between the outer surface of the inner tube 25, the inner surface of the outer housing 24, and an end of the disc-shaped gasket assembly 51 coupled to respective ends of the inner tube 25 and the outer housing 24.

In the example embodiments illustrated in FIG. 2A, the channel 51*c* does not extend through an interior space of the gasket 51 defined by the connector elements 51*b* but instead extends to an end of the space defined by the connector elements 51*b*, such that a tube 25 may be received into the space defined by the connector elements 51*b* and may further be restricted from being received into channel 51*c*. In some example embodiments, including the example embodiments illustrated in FIGS. 1A-C, the channel 51*c* extends through at least the interior space of gasket 51 that is defined by the connector elements 51*b*. As shown in FIG. 1B, in some example embodiments the channel 51*c* is configured to receive tube 25 through at least a portion of the channel 51*c*.

As shown in FIG. 2A, the gasket assembly 51 includes a channel 51*c* that defines an outlet portion of the channel 28. The channel 51*c* is coupled to the inner tube 25 via connector element 51*a*. The channel 51*c* defines an outlet portion of the channel 28 that extends beyond the inner tube 25 and through the gasket assembly 51 to opening 50*b*.

In the example embodiments illustrated in FIG. 2A, the gasket assembly 51 includes one or more connector elements 52 configured to couple the flavor insert 80 to the pre-vapor formulation tank section 70 if and/or when the flavor insert 80 is inserted through the opening 50*b* to position the flavor insert 80 at an outlet portion (second portion) of the channel 28. In some example embodiments, the one or more connector elements 52 include an individual connector element that extends around an inner surface of the channel 28. In some example embodiments, including the example embodiments illustrated in FIG. 2A, the one or more connector elements 52 are coupled to an inner surface of the channel 51*c* of the gasket assembly 51. In the example embodiments illustrated in FIG. 2A, connector elements 52 extend through a portion of channel 51*c*, such that a gap is present between the connector elements 52 and an end of the channel 51*c* that is proximate to connector elements 51*b*. It will be understood that, in some example embodiments, one or more connector elements 52 may extend through an entirety of the length of the channel 51*c*. In some example embodiments, one or more connector elements 52 are coupled to the inner surface of the inner tube 25.

The one or more connector elements 52 may include one or more types of connectors. In some example embodiments, one or more connector elements 52 are friction fit connectors that are configured to couple the flavor insert 80 to the pre-vapor formulation tank 22 through a friction fit between an outer surface of the flavor insert 80 and the one or more connector elements 52. In some example embodiments, one or more connector elements 52 are coupling devices configured to mechanically couple with one or more connector elements included in the flavor insert 80. For example, one or more connector elements 52 may be a threaded connector, a bayonet connector, etc. configured to couple with a complementary connector included in the flavor insert 80 if and/or when the flavor insert 80 is inserted into the pre-vapor formulation tank section 70 through opening 50*b*.

In some example embodiments, one or more of the connector elements 52 is configured to establish an airtight or substantially airtight seal between the flavor insert 80 and a surface of the channel 28 if and/or when the flavor insert 80 is inserted through the opening 50*b* and into the channel 28. The one or more connector elements 52 may configure the pre-vapor formulation tank section 70 to direct a generated vapor 95 passing though the channel 28 to pass through the flavor insert 80 to exit the pre-vapor formulation tank section 70.

Referring to FIG. 2B, in some example embodiments, a pre-vapor formulation tank section 70 includes a pre-vapor formulation tank 22 that excludes a gasket assembly 51 at an outlet end, such that the pre-vapor formulation tank 22 includes an outer housing 24 and an inner tube 25 that at least partially define a reservoir 23 that may hold pre-vapor formulation. As shown in FIG. 2B, the outer housing 24 and inner tube 25 collectively define an outlet end of the reservoir 23. The example embodiments illustrated in FIG. 2B show the outer housing 24 being curved towards the inner tube 25. However, it will be understood that other configurations of the outer housing 24 and the inner tube 25 are encompassed by the example embodiments.

In the example embodiments illustrated in FIG. 2B, the outer housing 24 and inner tube 25 are coupled together at an outlet end of the pre-vapor formulation tank 22 to define an outlet end enclosure of the reservoir 23. The outer housing 24 and inner tube 25 may be coupled together via one or more of an adhesive, a coupling device, a weld, a sealing element, some combination thereof, or the like.

In some example embodiments, the outer housing 24 and the inner tube 25 comprise an individual element that defines both the reservoir 23 and the channel 28. For example, the pre-vapor formulation tank 22 may include a single piece of material that is shaped approximately annularly, such that the piece of material defines the reservoir 23 and the channel 28 as separate spaces that are separated by one or more portions of the piece of material. The piece of material may be a translucent and/or transparent piece of material.

In the example embodiments illustrated in FIG. 2B, the pre-vapor formulation tank 22 includes one or more connector elements 52 configured to couple the flavor insert 80 to the pre-vapor formulation tank section 70 if and/or when the flavor insert 80 is inserted through the opening 50*b* to position the flavor insert 80 at an outlet portion of the channel 28. In some example embodiments, the one or more connector elements 52 are an individual connector element that extends around an inner surface of the inner tube 25.

Referring to FIGS. 2A-B, in some example embodiments, the one or more connector elements 52 may be absent from the pre-vapor formulation tank 22, and one or more of the gasket assembly channel 51*c* and the outlet end of the inner tube 25 is configured to establish a friction fit connection with an outer surface of the flavor insert 80 if and/or when the flavor insert 80 is inserted through the outlet end opening 50*b*. Such a friction fit connection may seal or substantially seal the interface between the outer surface of the flavor insert 80 and the channel 28. As a result, a generated vapor 95 passing through the channel 28 towards opening 50*b* may be directed to pass through the flavor insert 80 to form a flavored vapor 97.

FIG. 3A, FIG. 3B, FIG. 3C, and FIG. 3D are cross sectional views of a flavor insert 80 according to some example embodiments. The flavor inserts 80 illustrated in FIGS. 3A-f) may be included in any of the embodiments of flavor inserts included herein, including the flavor insert 80 illustrated in FIGS. 1A-C and FIGS. 2A-B.

Referring to FIGS. 3A-D, the flavor insert 80 includes a tip end opening 80*a* and an outlet end opening 80*b*. The flavor insert 80 is configured to receive a vapor, including a generated vapor 95, through the tip end opening 80*a* and into an interior of the flavor insert 80. The flavor insert 80 is further configured to direct a vapor, including a flavored vapor 97 formed through flavorant elution into the generated vapor 95, out of the flavor insert 80 via the outlet end opening 80*b*.

Figure 3A:
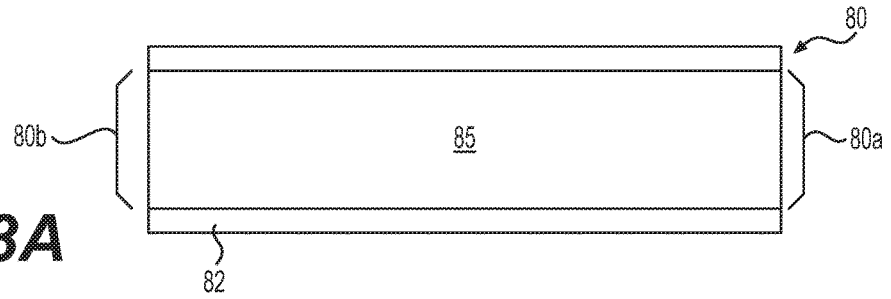
FIG. 3A, FIG. 3B, FIG. 3C, and FIG. 3D are cross sectional views of flavor inserts according to some example embodiments.

Referring to FIG. 3A, in some example embodiments, the flavor insert 80 includes a flavor material 85 holding a flavorant and a containment structure 82 at least partially enclosing the flavor material 85 within the interior of the flavor insert 80. The containment structure 82 may enclose side portions of the flavor insert 80 to define openings 80*a*, 80*b* at opposite ends of the flavor insert 80. The containment structure 82 is also referred to herein as an outer housing of the flavor insert 80. In some example embodiments, the containment structure 82 may be referred to as an outer surface area of the flavor material 85.

The flavor material 85 may be a porous structure in which one or more flavorants are included. In some example embodiments, the flavor material 85 is a collection of flavor materials. In some example embodiments, the flavor material 85 includes one or more botanical materials. In some example embodiments, the flavor material 85 includes one or more types of tobacco. In some example embodiments, a flavor insert 80 that includes one or more types of tobacco as the flavor material 85 may be referred to as a tobacco element. A flavor material 85 that includes tobacco may be referred to herein as a tobacco flavor material 85.

Figure 3B:
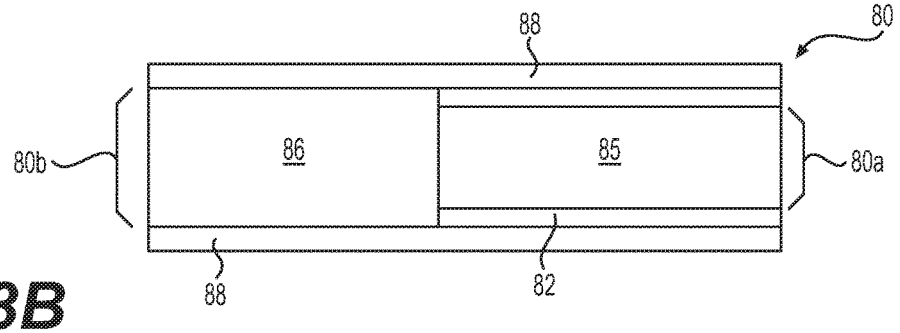

Referring to FIG. 3B, the flavor insert 80 may include a filter element 86 and a housing material 88 that encloses the filter element 86 and the containment structure 82 enclosing the flavor material 85. The filter element 86 may be configured to filter particulate matter from a vapor passing through the flavor insert 80. The filter element 86 may, in some example embodiments, include a hollow acetate tube (HAT) filter. The filter element 86 may be configured to provide reduced filtration efficiency, relative to filter elements 86 included in some example embodiments, such that a loss of vapor to the filter element 86 is reduced, relative to vapor loss to filter elements 86 in some example embodiments. The housing material 88 may enclose side portions of the filter element 86 to direct vapor exiting the flavor material 85 to pass through the filter element to opening 80*b*. In sonic example embodiments, the housing material 88 is a tipping paper. The housing material 88, as shown in the example embodiments of FIG. 3B, may overlap an outer surface area of the filter element 86 and an outer surface area of the flavor material 85.

Figure 3C:
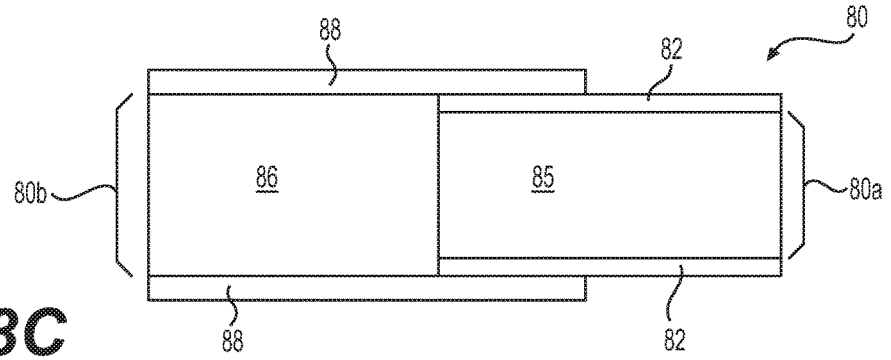

Referring to FIG. 3C, the housing material 88 may enclose a limited portion of the filter element 86 and flavor material 85. As shown in FIG. 3C, the housing material 88 may overlap the outer surface area of the filter element 86 and a limited portion of the outer surface area of the flavor material 85. As shown in FIG. 3C, where containment structure 82 encloses the side portions of the flavor material 85. The housing material 88 may overlap the sidewalls of the filter element 86 and a limited portion of the sidewalls of the containment structure 82.

Figure 3D:
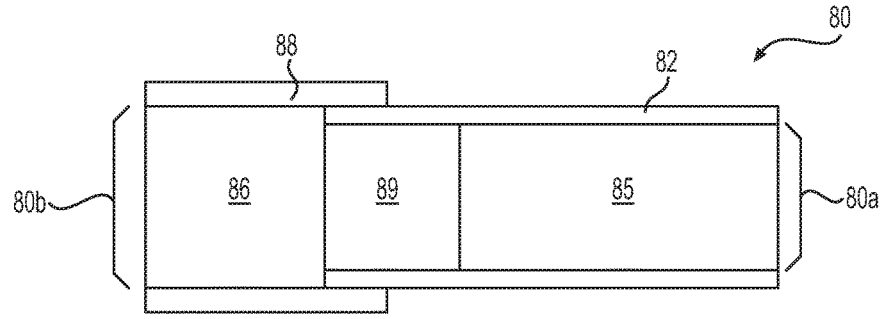

Referring to FIG. 3D, the flavor insert 80 may include multiple separate flavor materials 84, 89 that each hold a different flavorant. For example, in sonic example embodiments the flavor material 85 may be a first type of tobacco and the flavor material 89 may be a second type of tobacco. In another example, the flavor material 85 may be tobacco and the flavor material 89 may be a non-tobacco material. As shown in FIG. 3D, the housing material 88 may overlap a limited portion of an outer surface of the flavor material 89. In some example embodiments, the housing material 88 may overlap at least a portion of the outer surface of the flavor material 89 and at least a portion of the outer surface of the flavor material 85.

Referring to FIGS. 3A-D, in some example embodiments, the flavor insert 80 is a cigarette that includes a flavor material 85 that is one or more types of tobacco and is configured to combust the tobacco flavor material 85. If and/or when the flavor insert 80 is a cigarette that includes a flavor material 85 and a filter element 86, the filter element 86 may be a cigarette filter. In some example embodiments, if and/or when the flavor insert 80 is a cigarette that includes housing material 88, the housing material 88 may be a cigarette tipping paper.

Still referring to FIGS. 3A-D, the flavor insert 80 may be a tobacco rod (e.g., a cigarette, cigar, cigarillo, some combination thereof, or the like) that may be inserted into the outlet end opening 50*b* of the pre-vapor formulation tank 22. In some example embodiments, at least the pre-vapor formulation tank section 70 is configured to provide a flavored vapor 97 based on directing the generated vapor 95 through the tobacco rod 80 such that the generated vapor 95 elutes flavorant from the tobacco included in the cigarette to form the flavored vapor 97 independently of and/or without any combustion of the tobacco rod. The pre-vapor formulation tank section 70 may thus be configured to form a flavored vapor 97 based on flavorant elution from tobacco included in the tobacco rod 80 without combustion of the tobacco rod 80.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A non-combustible vaping element comprising:

a pre-vapor formulation tank configured to contain a pre-vapor formulation, the pre-vapor formulation tank defining a channel there through;

a heating element coupled to the pre-vapor formulation tank and configured to heat at least a portion of the pre-vapor formulation into a vapor and provide the vapor to a first portion of the channel through the pre-vapor formulation tank;

a tobacco element at a second portion of the channel through the pre-vapor formulation tank and positioned to receive the vapor; and a gasket defining an outlet end of the pre-vapor formulation tank, the gasket including a connector configured to couple the tobacco element to the pre-vapor formulation tank at the second portion of the channel through the pre-vapor formulation tank, the tobacco element extending through the connector of the gasket and an entire channel of the gasket.

2. The non-combustible vaping element of claim 1, wherein the tobacco element and the heating element are at opposing ends of the channel through the pre-vapor formulation tank.

3. The non-combustible vaping element of claim 1, wherein the tobacco element is a detachable insert configured to be inserted into the channel through the pre-vapor formulation tank, the detachable insert including a tobacco flavor material.

4. The non-combustible vaping element of claim 3, wherein the detachable insert includes a filter at an end of the tobacco flavor material.

5. The non-combustible vaping element of claim 4, wherein the detachable insert includes tipping paper overlapping the filter and the tobacco flavor material.

6. The non-combustible vaping element of claim 4, wherein tipping paper covers outer surface areas of the filter and the tobacco flavor material.

7. The non-combustible vaping element of claim 4, wherein tipping paper covers an entire outer surface area of the tobacco flavor material.

8. The non-combustible vaping element of claim 3, wherein the detachable insert includes a flavor material holding at least one flavorant.

9. The non-combustible vaping element of claim 1, wherein the pre-vapor formulation includes nicotine.

10. The non-combustible vaping element of claim 1, wherein the pre-vapor formulation tank includes an outer housing and an inner tube, the inner tube defining the channel through the pre-vapor formulation tank.

11. The non-combustible vaping element of claim 10, wherein the outer housing, the gasket and the inner tube at least partially define a reservoir.

12. The non-combustible vaping element of claim 11, wherein the pre-vapor formulation tank is refillable.

13. The non-combustible vaping element of claim 12, wherein the gasket is at a first end of the pre-vapor formulation tank and a second end of the pre-vapor formulation tank defines an opening to the reservoir.

14. A non-combustible vaping device comprising:

a power supply section configured to supply power; and a non-combustible vaping element configured to receive the supplied power, the non-combustible vaping element including, a pre-vapor formulation tank configured to contain a pre-vapor formulation, the pre-vapor formulation tank defining a channel there through, a heating element coupled to the pre-vapor formulation tank and configured to heat at least a portion of the pre-vapor formulation into a vapor using the supplied power, the heating element configured to provide the vapor to a first portion of the channel through the pre-vapor formulation tank, a tobacco element at a second portion of the channel through the pre-vapor formulation tank and positioned to receive the vapor, and a gasket defining an outlet end of the pre-vapor formulation tank, the gasket including a connector configured to couple the tobacco element to the pre-vapor formulation tank at the second portion of the channel through the pre-vapor formulation tank, the tobacco element extending through the connector of the gasket and an entire channel of the gasket.

15. The non-combustible vaping device of claim 14, wherein the tobacco element and the heating element are at opposing ends of the channel through the pre-vapor formulation tank.

16. The non-combustible vaping device of claim 14, wherein the tobacco element is a detachable insert configured to be inserted into the channel through the pre-vapor formulation tank, the detachable insert including a tobacco flavor material.

17. The non-combustible vaping device of claim 16, wherein the detachable insert includes a filter at an end of the tobacco flavor material.

18. The non-combustible vaping device of claim 17, wherein the detachable insert includes tipping paper overlapping the filter and the tobacco flavor material.

19. The non-combustible vaping device of claim 17, wherein tipping paper covers outer surface areas of the filter and the tobacco flavor material.

20. The non-combustible vaping device of claim 17 herein tipping paper covers an entire outer surface area of the tobacco flavor material.

21. The non-combustible vaping device of claim 16, wherein the detachable insert includes a flavor material holding at least one flavorant.

22. The non-combustible vaping device of claim 14, wherein the pre-vapor formulation includes nicotine.

23. An e-vaping element, comprising:

a pre-vapor formulation tank configured to contain a pre-vapor formulation, the pre-vapor formulation tank defining a channel there through;

a heating element coupled to the pre-vapor formulation tank and configured to heat at least a portion of the pre-vapor formulation into a vapor and provide the vapor to a first portion of the channel through the pre-vapor formulation tank;

a detachable insert configured to be inserted into the channel through the pre-vapor formulation tank at a second portion of the channel through the pre-vapor formulation tank such that the detachable insert is positioned to receive the vapor, the detachable insert including a flavor material holding at least one flavorant, the detachable insert configured to release the at least one flavorant into the received vapor; and a gasket defining an outlet end of the pre-vapor formulation tank, the gasket including a connector configured to couple the detachable insert to the pre-vapor formulation tank at the second portion of the channel through the pre-vapor formulation tank, the detachable insert extending through the connector of the gasket and an entire channel of the gasket.

24. The e-vaping element of claim 23, wherein the pre-vapor formulation includes nicotine.

* * * * *